United States Patent [19]

Capecchi

[11] Patent Number: 4,476,358

[45] Date of Patent: Oct. 9, 1984

[54] TOUCH PAD INDICATING ARRIVAL DURING SWIMMING CONTESTS

[76] Inventor: Augusto Capecchi, Via Byron 16/9, Genoa, Italy

[21] Appl. No.: 165,742

[22] Filed: Jul. 3, 1980

Related U.S. Application Data

[63] Continuation of Ser. No. 341, Jan. 2, 1979, abandoned.

[51] Int. Cl.[3] ..... H01H 1/18; H01H 3/02

[52] U.S. Cl. ..... 200/52 R; 200/86 R; 200/241; 200/242; 200/283; 272/4

[58] Field of Search ..... 200/241, 242, 275, 283, 200/159 A, 159 B, 86 R, 52 R; 272/4

[56] References Cited

U.S. PATENT DOCUMENTS

| | | | |
|---|---|---|---|
| 459,984 | 9/1891 | Wilson | 200/86 R |
| 1,318,478 | 10/1919 | Buckles | 200/159 A |
| 1,614,887 | 1/1927 | Hill | 200/159 A |
| 3,250,882 | 5/1966 | Campbell et al. | 200/159 A |
| 3,745,275 | 7/1973 | Degiez | 200/86 R |
| 3,784,768 | 1/1974 | Hunt | 200/86 R |
| 3,916,214 | 10/1975 | Coble, Jr. et al. | 200/52 R |
| 3,944,763 | 3/1976 | Beierwaltes | 200/86 R |
| 3,967,084 | 6/1976 | Pounds | 200/159 B |
| 3,996,429 | 12/1976 | Chu et al. | 200/159 B |
| 4,033,030 | 7/1977 | Robinson et al. | 200/159 B |
| 4,071,718 | 1/1978 | Harden | 200/159 B |
| 4,086,451 | 4/1978 | Boulanger | 200/159 B |

FOREIGN PATENT DOCUMENTS

| | | | |
|---|---|---|---|
| 52-30534 | 3/1977 | Japan | 200/52 R |

*Primary Examiner*—John W. Shepperd

[57] ABSTRACT

A not-watertight touch pad for swimming competitions mounted partially submersed on the finishing wall of a swimming pool. It includes two plates located in front of each other, the front one of which is somehow perforated and loosely inserted in a frame consisting of channel sections on the four sides and movable towards the insulated back plate. Resting between the two plates, many turns of parallel conductive strips are bonded onto the back plate, whereas some hundreds of conductive springs shaped as seagull wings are welded onto the central strips. These springs are mounted perpendicularly to the strips and are acting as spacers between the two plates and as electrical contacts between the strips as soon as any pressure is applied on the front plate.

1 Claim, 3 Drawing Figures

TOUCH PAD INDICATING ARRIVAL DURING SWIMMING CONTESTS

This is a continuation of application Ser. No. 341 filed on Jan. 2, 1979 now abandoned.

SUMMARY OF THE INVENTION

The invention is consisting of a pad having approximately the width of a swimming lane and about one meter high, the thickness of which is to be less than one centimeter, in compliance with the specifications of the Swimming Federation. The pad is operating in vertical position, applied against the peripheral pool wall and partially imimmersed in the water.

The pads will be as many as there are swimming lanes; they are electrically powered and each pad is generating an electrical signal as soon as the swimmer applies a slight pressure on turning or upon arrival.

DESCRIPTION OF THE INVENTION

Figure 1:
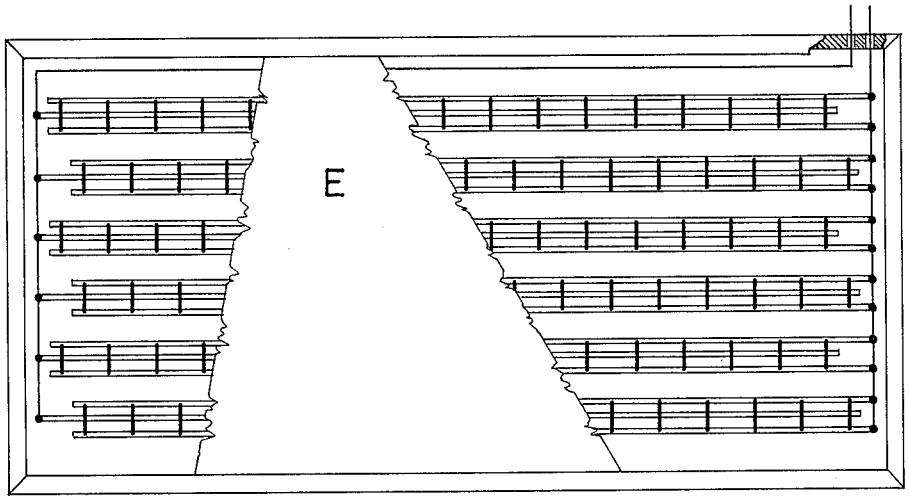
FIG. 1 is a plan view of the contact pad without the cover.
Figure 2:
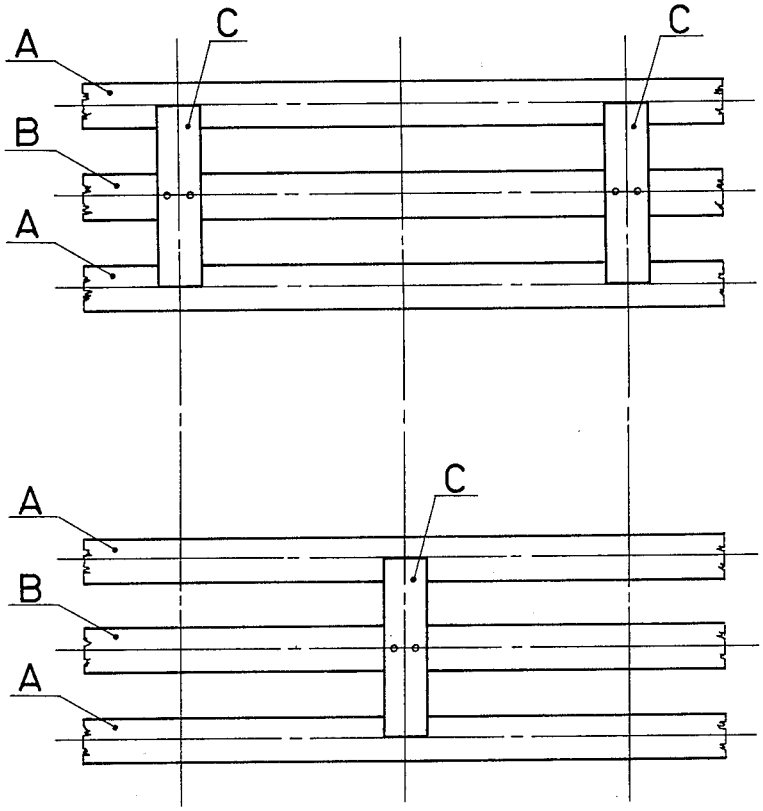
FIG. 2 is a detailed view of the contacts.
Figure 3:
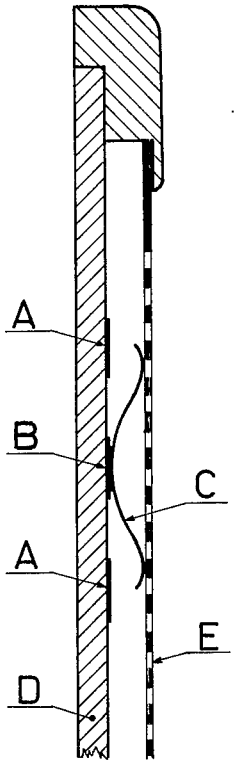
FIG. 3 is a side view of the contact pad.

Compared with other known types, the invention has the following characteristics:

(1) the signal is transmitted without any delay, unlike other systems;

(2) the sensitivity of the pad is constant over its entire surface, since its operating principle is based on approx. 400 mechanical contacts;

(3) it requires no sealed envelope which might give rise to seepage in the length of time;

(4) even strong localized forces may be applied without causing damage;

(5) the pad is insensitive to wave motion;

(6) contacts are of the self-cleaning type.

The technical particulars of the invention are outlined hereinafter.

The pad is composed of two plates located face to face, the rear one being in stratified plastic or electrically insulated metal, resting against the vertical wall of the swimming pool, whereas the front plate is consisting of a metal or plastic sheet of approximately 1 mm thickness, preforated over its entire surface so as to reduce its resistance to motion in water. The latter sheet is kept in position by an external frame anchored onto the backing plate.

A contact/spacer springs system is mounted on the back plate covering its whole surface as illustrated in the enclosed drawing. The metal strips A and B are glued onto the back plate whereas the contact springs C are in material having a very high yield strength and are mechanically and electrically bonded onto the strips B.

The elements C are having a dual scope: they must close the contact between the strips A and B under external forces applied to the perforated sheet E and they must serve as an elastic spacer between the two plates D and E.

Furthermore, the contact has a self-cleaning action, due to the flattening of its terminal section involving a cleaning action on the strip surface. It should be noted that any pressure on the plate E will cause its local deformation and the transfer of the force onto the contact springs nearest to the pressure point. In this way, almost the whole thrust applied by the swimmer is transferred to the contact springs.

All surfaces of the strips and of the contact springs not involved in the contact zone are carefully waterproofed. The electrical impedance of the water immersed pad depends on various factors, but its operation is always achieved by impedance variation caused by closing of one or more contacts between the strips A and B. The voltage and frequency of the energy supply will be determined after tests carried out in practical utilization conditions. As a rule, 6 V voltage is used at a frequency of 500/1000 Hz in sinusoidal wave. In its practical implementation the invention may also take shapes other than described above. For instance, the configuration, material and arrangement of the elastic elements, of the strips or plates may be changed, while remaining within the scope of this Patent.

I claim:

1. A touch pad for swimming competitions for mounting partially submerged on the finishing wall of a swimming pool consisting of:

an insulating back plate for mounting adjacent the pool wall, a striker plate perforated to allow the free flow of water mounted in front of said back plate, a frame attached to the back plate for loosely mounting the striker plate to allow movement of said striker plate towards said back plate when touched by a swimmer.

a plurality of conductive strips mounted onto the insulating back plate with said strip being formed in sets of three with the center strip of each set being electrically connected and with the outer pair of each set being electrically connected, a plurality of conductive springs welded onto the central strips shaped as seagull wings to act as resilient spacers between the striker plate and the insulating plate and to act as self cleaning electrical contacts between the center strip and the outer pair and, water proofing means on the strips and spring except in the contact zones.

* * * * *